US008984896B2

(12) United States Patent
Davenport et al.

(10) Patent No.: US 8,984,896 B2
(45) Date of Patent: Mar. 24, 2015

(54) INTERLOCKING COMBUSTOR HEAT SHIELD PANELS

(71) Applicant: Pratt & Whitney Canada Corp., Longueuil (CA)

(72) Inventors: Nigel Caldwell Davenport, Hillsburgh (CA); Eduardo David Hawie, Woodbridge (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 0 days.

(21) Appl. No.: 13/974,452

(22) Filed: Aug. 23, 2013

(65) Prior Publication Data

US 2015/0052901 A1 Feb. 26, 2015

(51) Int. Cl.
*F02C 7/20* (2006.01)
*F02C 1/00* (2006.01)
*F23R 3/00* (2006.01)

(52) U.S. Cl.
CPC ..... *F23R 3/002* (2013.01)
USPC ..... 60/796; 60/752

(58) Field of Classification Search
USPC ..... 60/740, 742, 752–760, 796
See application file for complete search history.

(56) References Cited

U.S. PATENT DOCUMENTS

| | | | | |
|---|---|---|---|---|
| 4,614,082 | A | 9/1986 | Sterman et al. | |
| 4,776,790 | A | 10/1988 | Woodruff | |
| 4,944,151 | A | 7/1990 | Hovnanian | |
| 5,419,115 | A * | 5/1995 | Butler et al. | 60/804 |
| 5,956,955 | A * | 9/1999 | Schmid | 60/748 |
| 5,996,335 | A * | 12/1999 | Ebel | 60/800 |
| 6,276,142 | B1 | 8/2001 | Putz | |
| 6,497,105 | B1 * | 12/2002 | Stastny | 60/796 |
| 6,675,586 | B2 | 1/2004 | Maghon | |
| 6,901,757 | B2 | 6/2005 | Gerendas | |
| 7,021,061 | B2 | 4/2006 | Tiemann | |
| 7,677,044 | B2 | 3/2010 | Barbeln et al. | |
| 7,770,398 | B2 * | 8/2010 | De Sousa et al. | 60/752 |
| 7,900,461 | B2 | 3/2011 | Varney et al. | |
| 8,104,287 | B2 | 1/2012 | Fischer et al. | |
| 8,683,806 | B2 * | 4/2014 | Commaret et al. | 60/752 |
| 2008/0115499 | A1 * | 5/2008 | Patel et al. | 60/752 |
| 2008/0282703 | A1 * | 11/2008 | Morenko et al. | 60/796 |

* cited by examiner

*Primary Examiner* — Gerald L Sung
(74) *Attorney, Agent, or Firm* — Norton Rose Fulbright Canada LLP

(57) ABSTRACT

A combustor heat shield assembly comprises a circumferential array of heat shield panels individually mounted to an inner surface of a combustor shell. Each heat shield panel has a sealing rail extending from a back side thereof and a plurality of bolted connections securely holding the heat shield panel on the combustor shell with the sealing rail in sealing contact with the inner surface of the combustor shell. Each pair of adjacent heat shield panels comprises first and second panels having adjoining lateral edges, the first panel having a boltless area on its back side at a location adjacent to its adjoining lateral edge. The second panel has a first one of its bolted connections provided adjacent to its adjoining lateral edge and in facing relationship with the boltless area of the first panel. A tab projects from the lateral edge of the second panel in overlapping relationship with at least a portion of the boltless area of the first panel for transferring a force from the first bolted connection of the second panel to the boltless area of the first panel.

15 Claims, 4 Drawing Sheets

INTERLOCKING COMBUSTOR HEAT SHIELD PANELS

TECHNICAL FIELD

The application relates generally to gas turbine engine and, more particularly, to combustor heat shield panels.

BACKGROUND OF THE ART

Combustor heat shields panels are typically attached to the combustor liner by means of studs extending from at least each corner of the panels. The studs have threaded distal ends for engagement with nuts on the outside of the combustor shell. A plurality of studs must be provided on each panel to ensure proper sealing contact between the sealing rails provided on the back side of the heat shield panels and the inner surface of the combustor shell.

Studs add weight and cooling complexity, and therefore room for improvement exists.

SUMMARY

In one aspect, there is provided a combustor heat shield assembly comprising a circumferential array of heat shield panels individually mounted to an inner surface of a combustor shell, each pair of adjacent heat shield panels comprising first and second panels having adjoining lateral edges, a stud projecting from a first corner region on the back side of the first panel adjacent its adjoining lateral edge, a tab projecting from said corner region of said first panel in overlapping relationship with an adjacent corner region on said second panel, the adjacent corner region of the second panel having no stud.

In another aspect there is provided a combustor heat shield assembly comprising a circumferential array of heat shield panels individually mounted to an inner surface of a combustor shell, each heat shield panel having opposed lateral edges extending between opposed circumferentially extending edges, each heat shield panel further having a sealing rail extending from a back side thereof and a plurality of bolted connections securely holding the heat shield panel on the combustor shell with said sealing rail in sealing contact with the inner surface of the combustor shell, wherein each pair of adjacent heat shield panels comprises first and second panels having adjoining lateral edges, said first panel having a boltless area on the back side thereof at a location adjacent to its adjoining lateral edge, wherein a first one of the bolted connections of the second panel is provided adjacent to its adjoining lateral edge and in facing relationship with said boltless area of said first panel, and wherein a tab projects from the adjoining lateral edge of the second panel in overlapping relationship with at least a portion of said boltless area of said first panel, the tab transferring a force from the first bolted connection of the second panel to the boltless area of the first panel.

In a further aspect, there is provided a combustor comprising a combustor shell circumscribing a combustion chamber, at least one circumferential array of heat shield panels mounted to an interior side of the combustor shell, the heat shield panels having a back side disposed in a spaced-apart facing relationship with the interior side of the combustor shell, the heat shield panels having studs extending from the back side thereof and through corresponding mounting holes defined in the combustor shell, each stud having a threaded distal end portion extending beyond an outer side of the combustor shell and carrying a nut, the heat shield panels further having sealing rails extending from the back side thereof in sealing engagement with the interior side of the combustor shell, wherein each pair of adjacent heat shield panels comprises first and second panels having adjoining lateral edges, said first panel having a studless corner area on the back side thereof at a location adjacent to its adjoining lateral edge, wherein a corner stud of the studs of the second panel is provided in a corner area thereof adjacent its lateral adjoining edge and generally in alignment with said studless corner area of said first panel, and wherein said first and second panels have overlapping lateral portions between said corner stud of the second panel and the studless corner area of the first panel, the lateral overlapping portions defining a load path for transferring a holding force from the corner stud of the second panel to the boltless corner area of the first panel, thereby pushing a portion of the sealing rail in the vicinity of the boltless corner area on the first panel in sealing contact with the interior side of the combustor shell.

In a still further general aspect, there is provided a combustor heat shield assembly comprising a circumferential array of heat shield panels individually mounted to an inner surface of a combustor shell, and an inter-panel support arrangement between at least one of two pairs of facing corner regions on opposite sides of a joint line between a pair of adjacent heat shield panels, the inter-panel support arrangement comprising a tab projecting from a first of said corner regions onto an opposite corner region in overlapping contact, and at most one stud bolt connection in the inter-panel support arrangement, said at most one stud bolt connection being provided at said first corner from which the tab extends.

DESCRIPTION OF THE DRAWINGS

Reference is now made to the accompanying figures, in which.

DETAILED DESCRIPTION OF THE PREFERRED EMBODIMENTS

Figure 1:
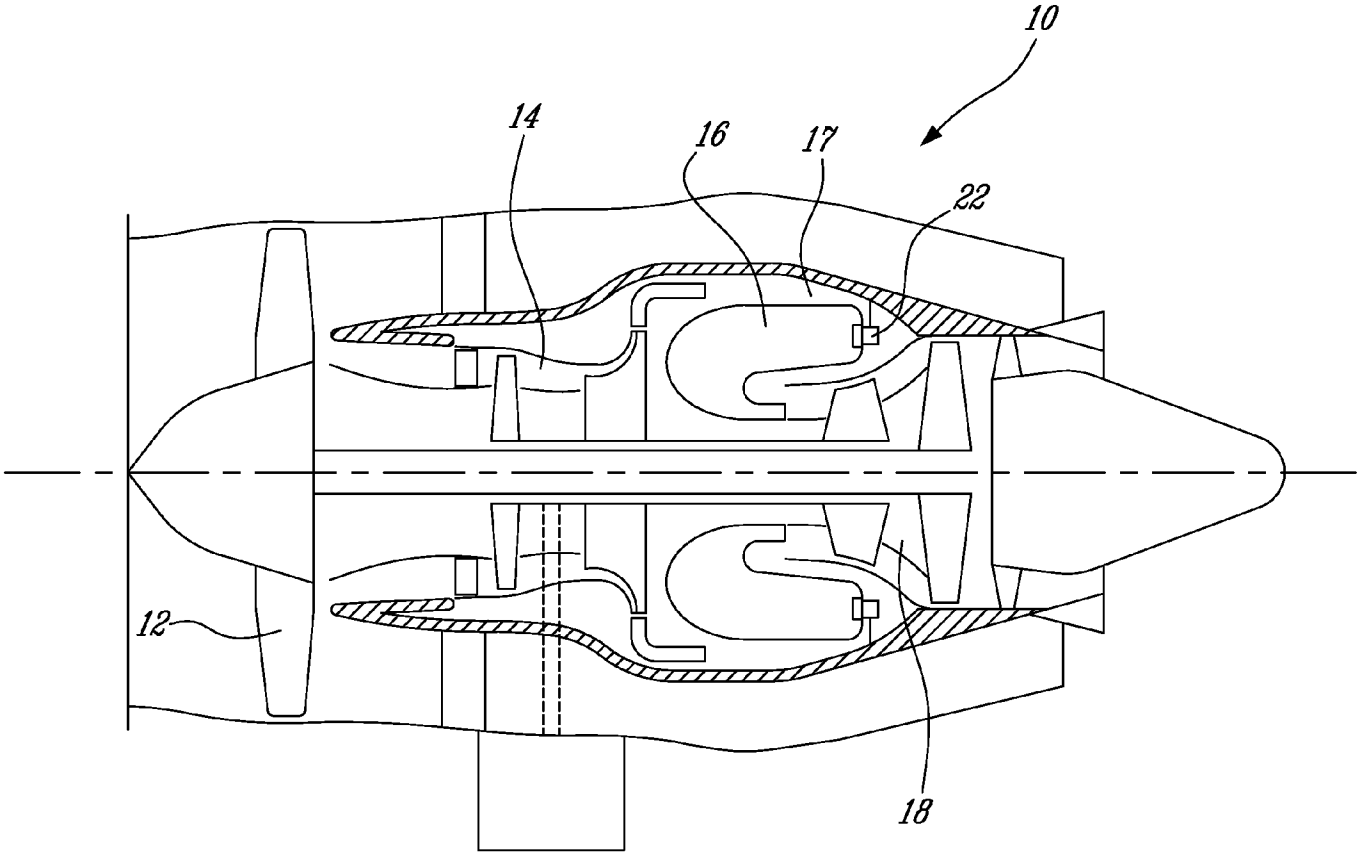
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
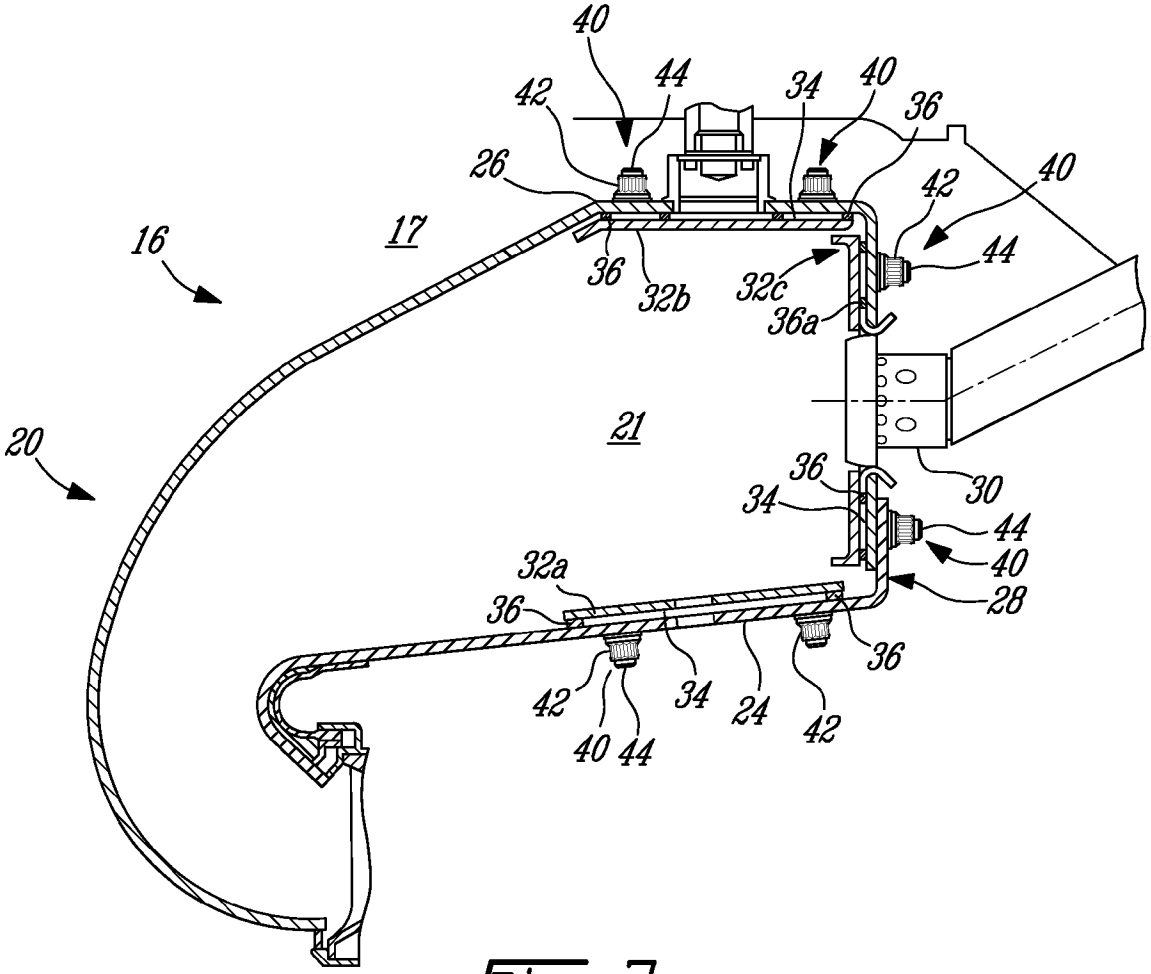
FIG. 2 is a schematic cross-section view of an annular combustor including a combustor shell and heat shield panels bolted to the combustor shell.

The combustor 16 is housed in a plenum 17 supplied with compressed air from compressor 14. As shown in FIG. 2, the combustor 16 typically comprises a sheet metal shell 20 including radially inner and radially outer liners 24, 26 extending from a bulkhead 28 so as to define an annular combustion chamber 21. A plurality of circumferentially spaced-apart nozzles (only one being shown at 30 in FIG. 2) are provided at the bulkhead 28 to inject a fuel/air mixture into the combustion chamber 21. Sparkplugs (not shown) are provided along the upstream end portion of the combustion chamber 21 downstream of the tip of the nozzles in order to initiate combustion of the fuel/air mixture delivered into the combustion chamber 21.

The radially inner and outer liners 24, 26 and the bulkhead 28 are provided on their hot interior side with heat shields. The heat shields can be segmented to provide a thermally decoupled combustor arrangement. For instance, circumferential arrays of heat shield panels 32*a*, 32*b* can be respectively mounted to the hot interior side of the radially inner and radially outer liners 24, 26, and another circumferential array of heat shield panels 32*c* can be mounted to the hot interior side of the bulkhead 28. It is understood that more than one circumferential array of heat shield panels can be mounted axially along the inner and outer liners 24, 26. Reference numeral 32 will be used herein after to generally refer to the heat shield panels irrespectively of their positions on the combustor shell 20.

The heat shield panels 32 are mounted to the combustor shell 20 with the back face of the heat shield panels 32 in closed facing, space-apart, relationship with the interior surface of the combustor shell 20. The back face of the heat shield panels 32 and the interior surface of the combustor shell 20 define an air gap 34 for receiving cooling air to cool down the heat shield panels 32. Cooling holes, such as impingement holes (not shown), are defined in the combustor shell 20 for directing air from the plenum 17 into the air gap 34. Sealing rails 36 projecting from the back side of the heat shield panels 32 into sealing engagement with the interior surface of the combustor shell 20 provide for the compartmentalization of the air gap 34 formed by each array of heat shield panels 32 and the interior side of the combustor shell 20. The sealing rails 36 may take various forms. For instance, they can take the form of a ring 36*a* (FIGS. 4*a* and 4*b*) surrounding a fuel nozzle opening 38 defined in a bulkhead heat shield 32*c*, a peripheral rim or even just a ridge extending integrally from the back side of a heat shield panel. The term "sealing rail" is herein intended to encompass all types of sealing surfaces projecting from the back side of the heat shields for engagement with the interior side of the combustor shell.

As shown in FIG. 2, bolted connections 40 may be provided for individually securing the heat shield panels 32 in position relative to the combustor shell 20 with the sealing rails 36 of the panels in sealing contact with the interior side of the combustor shell 20. As shown in FIG. 2, the bolted connections 40 may, for instance, include self-locking nuts 42 threadably engaged on the threaded distal end of studs 44 projecting from the back side of the heat shield panels 32. The studs 44 may be integrally cast with the panels 32. Alternatively, the studs may be joined to the panels by any suitable joining techniques.

Figure 4A:
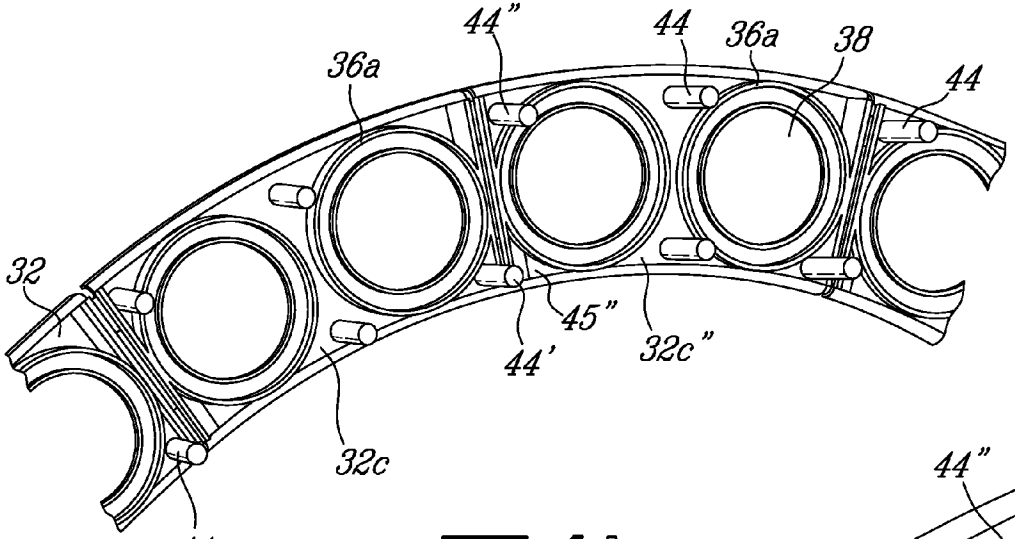
FIG. 4*a* is a back isometric view of a portion of the circumferential array of heat shield panels and illustrating the distribution of studs on the panels.
Figure 4B:
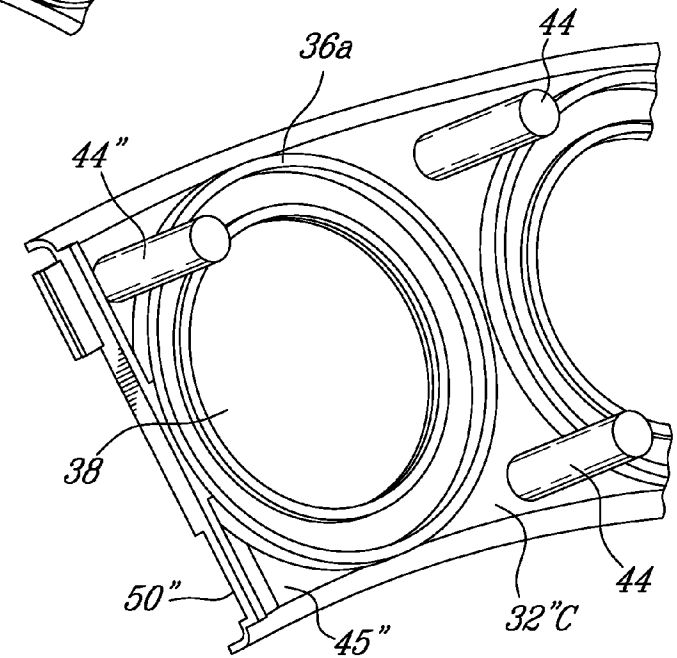
FIG. 4*b* is a back enlarged view of the lateral end portion of one of the panel and illustrating the interlocking features thereof in relation to the positioning of the studs.

More particularly, as shown in FIG. 4*a* with reference to the bulkhead heat shield panels 32*c*, each individual heat shield panel has a plurality of studs 44 projecting from the back side thereof for engagement in corresponding mounting holes defined in the combustor shell 20. The threaded distal end of the studs 44 extends beyond the shell exterior surface for engagement with the nuts 42. After engagement of the nuts 42 with the exterior surface of the combustor shell 20, the continued tightening of the nuts 42 causes the sealing rails 36 of the heat shield panels to be drawn against the interior surface of the combustor shell 20. To ensure proper sealing contact between the rails 36 and the interior surface of the combustor shell 20 a plurality of bolted connections is provided for each panel. Typically, a stud is provided at each corner of the panels and other studs are provided along the opposed circumferential edges of the panel. The provision of so many threaded connections on a combustor shell may be problematic, especially for small gas turbine engines. The number of threaded connections and, thus, the number of required studs and corresponding mounting holes in the combustor shell, may be reduced by providing interlocking features between adjacent heat shield panels to provide a load transfer path to transfer the holding force of a bolted connection of one panel to an adjacent one of the panels, thereby allowing to eliminate a bolted connection on said adjacent one of the panels.

FIGS. 3*a*, 3*b*, 4*a* and 4*b* illustrate one example of an interlocking scheme or inter-panel support arrangement in which adjacent heat shield panels are used to provide the force to ensure sealing of the heat shield panels to the combustor shell with a reduced number of bolted connections. The exemplary embodiment is disclosed in relation to the bulkhead heat shield panels 32*c* but it is understood that similar arrangements could be provided for the heat shield panels 32*a*, 32*b* mounted to the radially inner and outer liners 24, 26.

As can be appreciated from FIG. 4*a*, a single stud 44 may be provided at each opposed lateral ends of the heat shield panels with the studs adjacent to the interface between two adjacent panels being diametrically opposed to each other. For instance, for each pair of adjacent panels, a first panel 32*c*' may have a stud 44' provided in a first corner thereof and a second adjacent panel 32*c*" may have a stud 44" provided in a second corner thereof, the first and second corners being diametrically opposed to each other. The stud 44' of the first panel 32*c*' faces a studless corner area 45" of the second panel 32*c*". Likewise, the stud 44" of the second panel 32*c*" faces a studless corner area 45' of the first panel 32*c*'. The need for a stud in each of the studless corners may be avoided by the provision of overlapping portions between the first and second adjacent panels 32*c*' and 32*c*". The overlapping portions are configured to transfer a force from the stud 44" of the second panel 32*c*" to the studless corner area 45' of the first panel 32*c*' and from the stud 44' of the first panel 32*c*' to the studless corner area 45" of the second panel 32*c*".

Referring concurrently to FIGS. 3*a*, 3*b*, 4*a* and 4*b*, it can be appreciated that the overlapping portions can take the form of tabs extending from the lateral adjoining edges of the first and second adjacent panels 32*c*', 32*c*" for engagement with corresponding seats (e.g. recesses or slots) defined in the other one of the first and second adjacent panels. For instance, a first tab 48' (FIG. 3*b*) may extend from the lateral edge of the first panel 32*c*' generally in alignment with the stud 44' for mating engagement in a recess 50" (FIG. 4*b*) defined in the front face of the second panel 32*c*" at a location generally corresponding or adjacent to the studless corner area 45". The tension in stud 44' of the first panel 32*c*' is transferred to the studless area 45" of the second panel 32*c*" via the tab 48', thereby ensuring proper sealing contact between the second panel 32*c*" and the combustor shell 20 in the vicinity of the boltless corner area. Likewise, a second tab 48" (FIG. 4*b*) may extend from the lateral edge of the second panel 32*c*" generally in alignment with the stud 44" for mating engagement in a recess 50' (FIG. 3*b*) defined in the front face of the first panel 32*c*' at a location generally corresponding or adjacent to the studless corner area 45'. The tension in stud 44" of the second panel 32*c*" is transferred to the studless area 45' of the first panel 32*c*' via tab 48".

As can be appreciated from the foregoing, the load transmission paths provided by the tabs 48', 48" bearing against the adjacent studless regions 45', 45" of the adjacent panels allow the use of a single bolt connection for two adjacent corners of two different panels. It is understood that the above arrangement is not limited to corner studs and that similar load transmission paths could be used in combination with studs disposed at different locations on the back side of the panels. In this way, the number of required bolted connections can be significantly reduced.

It is also contemplated to use two tabs on a first adjacent heat shield panel and two mating recesses on the second adjacent panel. The tabs would be aligned with adjacent studs provided at the top and bottom corners of the first heat shield panels. In this way the studs in the opposed facing corners of the second panel could be eliminated.

Figure 3B:
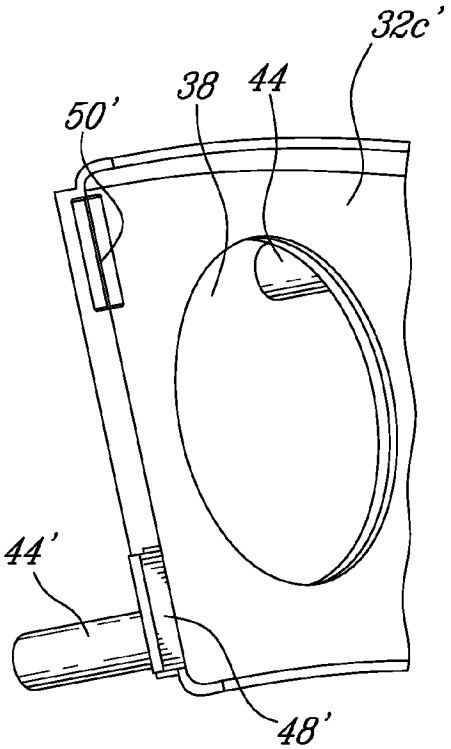
FIG. 3*b* is a front enlarged view of a lateral end portion of one of the two heat shield panels shown in FIG. 3*a* and illustrating details of the interlocking features of the panel.
Figure 3A:
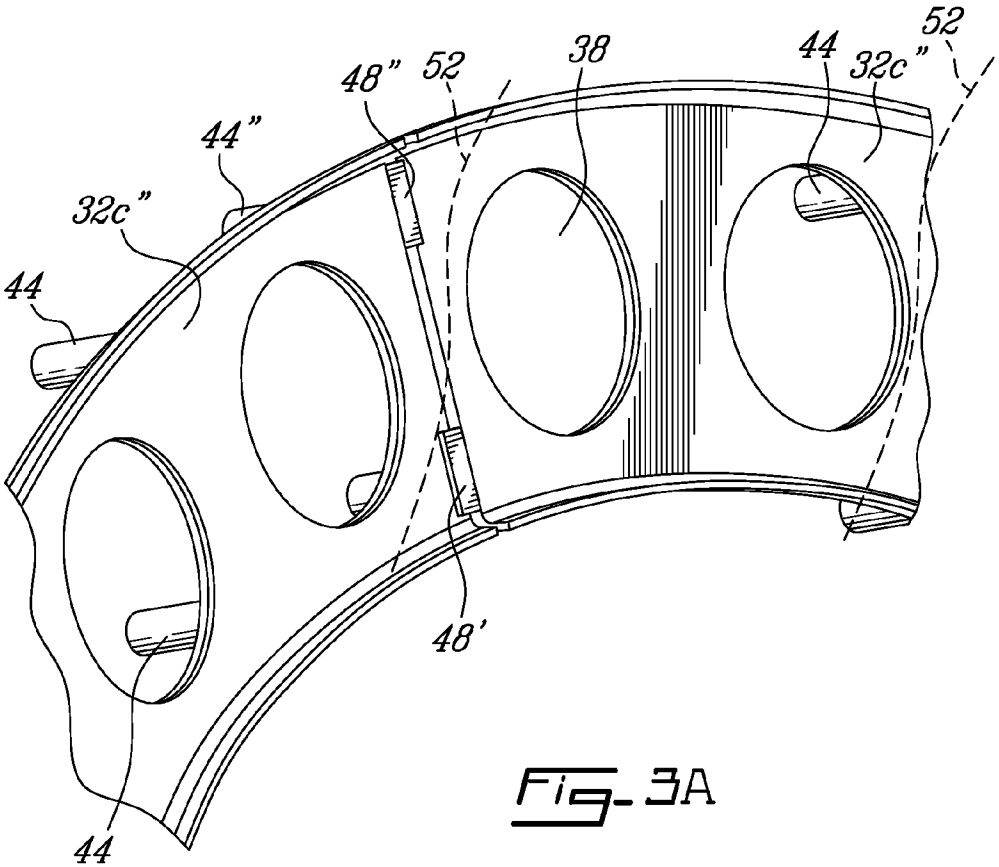
FIG. 3*a* a front isometric view of two adjacent heat shield panels of a circumferential array of panels and illustrating the interlocking engagement between the adjacent panels.

Furthermore, as depicted by dotted line 52 in FIG. 3*a*, the adjoining lateral edges of adjacent panels 32*c*', 32*c*" may have complementary non-linear profiles. More particularly, the adjoining lateral edges of first and second adjacent heat shield panels 32*c*', 32*c*" may have mutually corresponding surface contours defining a non-linear heat shield panel interface. In the illustrated embodiment, the heat shield panel interface is curved. However, it is understood that the adjoining lateral edges of the panels could have other non-linear profiles. As can be appreciated from FIG. 3*a*, the non-linear lateral edges 52 are asymmetric relative to a mean line extending centrally across the panel faces between the top and bottom circumferentially extending edges of the panels. The use of asymmetric panels provides for increased space for the disposition of the studs and nuts as well as providing more room for the tabs and complementary seats. This arrangement may be used to replace one stud by the use of tabs and slots together with the non-straight lateral edge profile. The sealing of the area of two adjacent corners may be done by the use of only one stud. This at the same time, allows more surface area of the heat shields to be exposed for the use of impingement cooling. It facilitates cooling by providing more room to get air flow in through the combustor shell 20 into the gap 34 between the heat shield panels 32 and the interior surface of the combustor shell 20. It thus allows for more efficient cooling and therefore contributes to ensure that durability requirements are met. It is noted that the asymmetric aspect could be used with or without the overlapping lateral features described herein above. Usually, the plane of symmetry of the panels is hard to cool since the sealing rails of two adjacent heat shield panels occupy the area taking away coolable surface area where hot spots may occur. Therefore, moving the sealing rails away from the plane of symmetry opens up the area to allow for cooling.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the appended claims.

What is claimed is:

1. A combustor heat shield assembly comprising a circumferential array of heat shield panels individually mounted to an inner surface of a combustor shell, each pair of adjacent heat shield panels comprising first and second panels having adjoining lateral edges, a stud projecting from a first corner region on the back side of the first panel adjacent its adjoining lateral edge, a tab projecting from said corner region of said first panel in overlapping relationship with an adjacent corner region on said second panel, the adjacent corner region of the second panel having no stud.

2. A combustor heat shield assembly as defined in claim 1, wherein the first and second panels further have respective sealing rails extending from the back side thereof, a nut being engaged on said stud for holding the first panel on the combustor shell with its sealing rail in sealing contact with the inner surface of the combustor shell, the tab transferring the holding force of the stud and the nut from the first panel to the second panel.

3. The combustor heat shield assembly defined in claim 1, wherein the second panel has a stud projecting from a second corner region thereof adjacent to its adjoining lateral edge, said second corner region being diagonally opposed to the first corner region of said first panel.

4. The combustor heat shield assembly defined in claim 3, wherein the second panel has a tab which projects laterally from said second corner region in overlapping relationship with a facing studless corner region at an end of the adjoining lateral edge of the first panel.

5. The combustor heat shield assembly defined in claim 1, wherein the tab is matingly received in a corresponding seat defined a front side of the second panel.

6. The combustor heat shield assembly defined in claim 1, wherein the tab is substantially centrally aligned with the stud along the adjoining lateral edge of the first panel.

7. The combustor heat shield assembly defined in claim 1, wherein the back side of each heat shield panel has four corners, and wherein at least one of said four corners is studless and pushed towards the inner surface of the combustor shell by a tab projecting laterally from the adjacent heat shield panels.

8. The combustor heat shield assembly defined in claim 1, wherein the back side of each heat shield panel has first and second pairs of diagonally opposed corners, the first pair of diagonally opposed corners being provided with respective studs, whereas the second pair of diagonally opposed corners has no stud.

9. A combustor comprising a combustor shell circumscribing a combustion chamber, at least one circumferential array of heat shield panels mounted to an interior side of the combustor shell, the heat shield panels having a back side disposed in a spaced-apart facing relationship with the interior side of the combustor shell, the heat shield panels having studs extending from the back side thereof and through corresponding mounting holes defined in the combustor shell, each stud having a threaded distal end portion extending beyond an outer side of the combustor shell and carrying a nut, the heat shield panels further having sealing rails extending from the back side thereof in sealing engagement with the interior side of the combustor shell, wherein each pair of adjacent heat shield panels comprises first and second panels having adjoining lateral edges, said first panel having a studless corner area on the back side thereof at a location adjacent to its adjoining lateral edge, wherein a corner stud of the studs of the second panel is provided in a corner area thereof adjacent its lateral adjoining edge and generally in alignment with said studless corner area of said first panel, and wherein said first and second panels have overlapping lateral portions between said corner stud of the second panel and the studless corner area of the first panel, the lateral overlapping portions defining a load path for transferring a holding force from the corner stud of the second panel to the boltless corner area of the first panel, thereby pushing a portion of the sealing rail in the vicinity of the boltless corner area on the first panel in sealing contact with the interior side of the combustor shell.

10. The combustor defined in claim 9, wherein said overlapping portions include a tab extending from the adjoining lateral edge of the second panel at a location generally aligned with said corner stud, and a seat defined in the adjoining lateral edge of the first panel, the tab being matingly received in the seat.

11. The combustor defined in claim 10, wherein said first panel has a corner stud adjacent to its adjoining lateral edge in a corner opposite to the studless corner area, said corner stud of said first panel facing a studless corner area on said second panel, and wherein said first and second panel have overlapping lateral portions between said corner stud of said first panel and said studless corner area of said second panel.

12. The combustor defined in claim 11, wherein the overlapping lateral portions between said corner stud of the second panel and the studless corner area of the first panel comprise a first tab projecting from the adjoining lateral edge of the second panel, and wherein the overlapping lateral portions between said corner stud of said first panel and said studless corner area of said second panel comprises a second tab projecting from the adjoining lateral edge of the first panel.

13. The combustor defined in claim 9, wherein the adjoining lateral edges of the first and second panels have complementary non-linear profiles.

14. The combustor defined in claim 9, wherein the adjoining lateral edges of the first and second heat shield panels have mutually corresponding surface contours defining a curved heat shield panel interface.

15. The combustor defined in claim 9, wherein the back side of each heat shield panel has first and second pairs of diagonally opposed corners, the first pair of diagonally opposed corners having studs extending therefrom, whereas the second pair of diagonally opposed corners is studless.

* * * * *